US006257206B1

(12) United States Patent
Doering et al.

(10) Patent No.: US 6,257,206 B1
(45) Date of Patent: Jul. 10, 2001

(54) SYSTEM FOR CONTROLLING AIR-FUEL RATIO DURING INTAKE CONTROL DEVICE TRANSITIONS

(75) Inventors: Jeffrey Allen Doering, Canton; Giuseppe D. Suffredini, Shelby Township; Jon Walter Halverson; Mark Thomas Linenberg, both of Dearborn; Paul Charles Mingo, Farmington Hills; Ralph Wayne Cunningham, Milan, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/496,540

(22) Filed: Feb. 2, 2000

(51) Int. Cl.[7] ..... F02M 51/00
(52) U.S. Cl. ..... 123/480; 123/492; 123/493
(58) Field of Search ..... 123/480, 492, 123/493, 478; 701/102

(56) References Cited

U.S. PATENT DOCUMENTS

| | | | | |
|---|---|---|---|---|
| 5,331,936 | * | 7/1994 | Messih et al. | 123/480 |
| 5,404,856 | | 4/1995 | Servati | 123/478 |
| 5,408,972 | | 4/1995 | Servati | 123/478 |
| 5,546,909 | | 8/1996 | Messih et al. | 123/492 |
| 5,564,393 | * | 10/1996 | Asano et al. | 123/492 |
| 5,584,277 | | 12/1996 | Chen et al. | 123/480 |
| 5,609,139 | * | 3/1997 | Ueda et al. | 123/492 |
| 5,735,249 | | 4/1998 | Parke et al. | 123/491 |
| 5,746,183 | | 5/1998 | Parke et al. | 123/492 |
| 5,762,054 | | 6/1998 | Schumacher | 123/674 |
| 5,819,714 | | 10/1998 | Bush et al. | 123/673 |
| 5,979,401 | * | 11/1999 | Hickey | 123/306 |
| 6,003,496 | * | 12/1999 | Maloney | 123/480 |
| 6,067,965 | * | 5/2000 | Trumpy et al. | 123/480 |

* cited by examiner

*Primary Examiner*—Henry C. Yuen
*Assistant Examiner*—Mahmoud Gimie
(74) *Attorney, Agent, or Firm*—John David Russell

(57) ABSTRACT

A method and system for controlling the fuel mass to be delivered to an individual cylinder of an internal combustion engine during engine transients caused by intake control device transitions. The method and system compensates for fuel transport dynamics and the actual fuel injected into the cylinder. A plurality of engine parameters are sensed, including cylinder air charge. An initial base desired fuel mass is determined based on the plurality of engine parameters. An initial transient fuel mass is also determined based on prior injection history which, in turn, is modified based on the transition of the intake control device for that cylinder. A desired injected fuel mass to be delivered to the cylinder is determined based on the initial base desired fuel mass and the initial transient fuel mass. These same calculations are then used to compensate for changes to the base desired fuel mass while the fuel injection is in progress, resulting in an updated desired injected fuel mass. Finally, the injection history for that cylinder is updated to account for the actual desired fuel mass delivered to the cylinder.

8 Claims, 2 Drawing Sheets

SYSTEM FOR CONTROLLING AIR-FUEL RATIO DURING INTAKE CONTROL DEVICE TRANSITIONS

TECHNICAL FIELD

The present invention relates generally to air-fuel controls for internal combustion engines and, more particularly, to a system for controlling air-fuel ratio during intake control device transitions.

BACKGROUND ART

Under steady-state engine operating conditions, the mass of air charge for each cylinder event is constant and the fuel transport mechanisms in the fuel intake have reached equilibrium. As a result, the mass of injected fuel for each cylinder event is also constant. When the operating condition is not steady-state, however, the mass of injected fuel required to achieve the desired air-fuel ratio in the cylinder is not constant. Transient operation can be due to changes in the mass of air charge, less than all of the cylinders being fueled for each event, or a desired change in the air-fuel ratio.

U.S. Pat. No. 5,746,183 describes a system for controlling fuel delivery during transient engine conditions using a series of steps. This method accomplishes improved fuel delivery by sensing a plurality of engine parameters. The method described includes the step of determining an initial base desired fuel mass based on the plurality of engine parameters. The method further includes the step of determining an initial transient fuel mass based on the prior injection history. Still further, the method includes the step of determining a desired injected fuel mass to be delivered to the individual cylinder based on the initial base desired fuel mass and the initial transient fuel mass. Finally, the method includes the step of sensing delivery of the desired injected fuel mass and determining an updated prior injection history based on the desired injected fuel mass and the prior injection history.

In engines equipped with intake manifold runner control (IMRC) systems, however, additional air-fuel control mechanisms may be required. In particular, during IMRC transitions when the engine is cold, the engine's air-fuel ratio goes lean on transitions to open the valve, and rich on transitions to close the valve. This can result in an undesirable torque 'bump' relating to air-fuel ratio control.

Thus, there exists a need to improve air-fuel control during intake control device transitions by compensating for fuel transport dynamics and the actual fuel injected into each cylinder.

SUMMARY OF THE INVENTION

It is an object of the invention to provide an improved and reliable means for controlling air-fuel ratio during intake control device transitions. Another object of the invention is to minimize lean air-fuel excursions during accelerations. An additional object of the invention is to minimize rich air-fuel excursions during decelerations.

In carrying out the above object and other objects, features, and advantages of the present invention, a method is provided for determining the fuel mass to be delivered to a cylinder during transient engine conditions caused by intake control device transitions. The method includes the step of sensing a plurality of engine parameters. The method also includes the step of determining an initial base desired fuel mass based on the plurality of engine parameters. The method further includes the step of determining an initial transient fuel mass based on the prior injection history, which is modified as a function of the intake control device transition. Still further, the method includes the step of determining a desired injected fuel mass to be delivered to the individual cylinder as a function of the initial base desired fuel mass and the initial transient fuel mass. The method further includes the step of sensing delivery of the desired injected fuel mass and determining an updated prior injection history as a function of the desired injected fuel mass and the prior injection history.

In further carrying out the above object and other objects, features, and advantages of the present invention, a system is also provided for carrying out the steps of the above described method. The system includes a plurality of sensors for sensing a plurality of engine parameters. The system also includes control logic operative to determine an initial base desired fuel mass as a function of the plurality of engine parameters and determine an initial transient fuel mass based on the prior injection history. The prior injection history is modified as a function of the intake control device transient. The system further includes control logic to determine a desired injected fuel mass to be delivered to the individual cylinder as a function of the initial base desired fuel mass and the initial transient fuel mass, and sense delivery of the desired injected fuel mass to the individual cylinder. The system further determines an updated prior injection history as a function of the desired injected fuel mass and the prior injection history.

The present invention achieves an improved and reliable means for controlling air-fuel ratio during intake control device transitions. Also, the present invention is advantageous in that it will overcomes the problem of torque 'bump' associated with cold engines.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODE(S) FOR CARRYING OUT THE INVENTION

Figure 1:
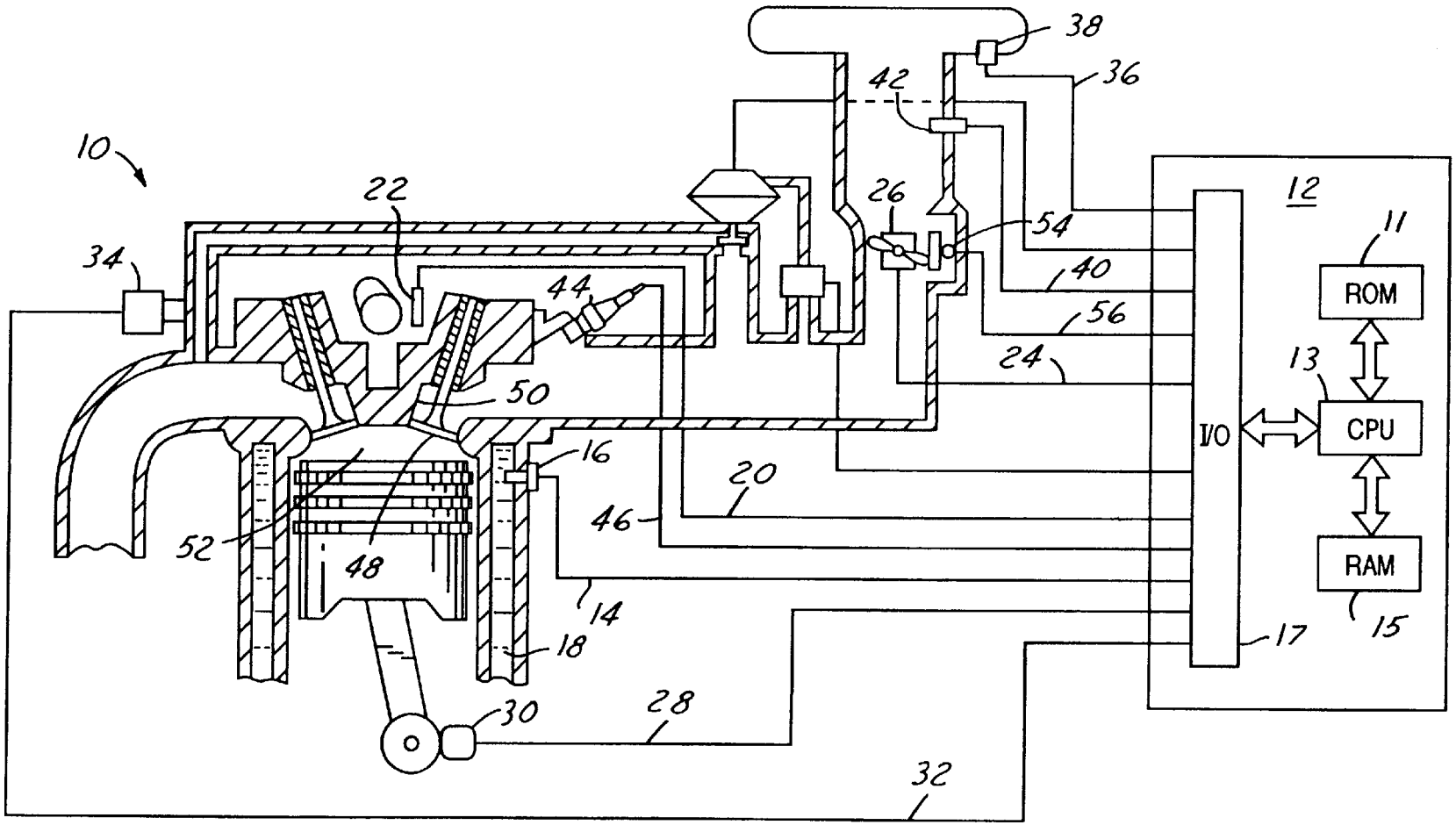
FIG. 1 is a schematic diagram of an internal combustion engine and an electronic engine controller in accordance with one embodiment of the present invention.

Referring to FIG. 1, a schematic diagram of an internal combustion engine and an electronic engine controller in accordance with one embodiment of the present invention is illustrated. The internal combustion engine 10 comprises a plurality of combustion chambers, or cylinders, one of which is shown in FIG. 1. An Electronic Control Unit (ECU) 12 controls the engine 10. The ECU 12 has a Read Only Memory (ROM) 11, a Central Processing Unit (CPU) 13, and a Random Access Memory (RAM) 15. The ECU 12 receives a plurality of signals from the engine 10 via Input/Output (I/O) port 17. These signals include, but are not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, and an airflow signal 40 from an airflow sensor 42.

The ECU 12 processes these signals received from the engine and generates a fuel injector pulse waveform transmitted to the fuel injector 44 on signal line 46 to control the amount of fuel delivered by the fuel injector 44.

The ECU 12 also generates an Intake Manifold Runner Control (IMRC) command transmitted to IMRC valve 54 on IMRC command line 56 to open IMRC valve 54 during acceleration or high RPM or close IMRC valve 54 during deceleration or low RPM.

Intake valve 48 operates to open and close intake port 50 to control the entry of an air-fuel mixture into combustion chamber 52. Intake valve 48 in combination with IMRC valve 54 allows for two-stage manifold operation. Two-stage manifold operation may also be achieved using a swirl control valve (SCV) or the like.

The airflow signal 40 (or air charge estimate) from airflow sensor 42 is updated every profile ignition pickup (PIP) event, which is used to trigger all fuel calculations. The current air charge estimate is used to calculate the desired in-cylinder fuel mass for all cylinders on each bank of the engine, wherein a bank corresponds to a group of cylinders with one head. This desired fuel mass is then used as the basis for all fuel calculations for the relevant cylinders on that bank, including initial main pulse scheduling, injector updates and dynamic fuel pulse scheduling. Since the initial main pulse for each cylinder must be scheduled in advance of delivery, the air charge estimate can change significantly during transient engine conditions. In order to achieve the desired in-cylinder air-fuel ratio, the initial pulse must be modified (injector updates) and possibly augmented with an open-valve injection (dynamic fuel pulse). The change in the bank-specific desired fuel mass, calculated from the latest estimate of cylinder air charge, is used to trigger all the calculations.

A discrete first-order X and tau model is used to design a fuel compensator for a multipoint injection system, where X represents the fraction of fuel injected into the cylinder which will form a puddle in the intake port and tau represents a time constant describing the rate of decay of the puddle into the cylinder at each intake event. The discrete nature of the compensator reflects the event-based dynamics that occur in the engine cycle. These variables are readily ascertained by known methods of engine mapping and calibration.

In operation, an initial base desired fuel mass is determined based on a plurality of engine parameters. An initial transient fuel mass is then determined based on the initial base desired fuel mass and a prior injection history including a history of transient fuel puddle mass in the intake manifold. A desired injected fuel mass is then determined to be delivered to the individual cylinder based on the initial base desired fuel mass and the initial transient fuel mass. Finally, delivery of the desired injected fuel mass to the individual cylinder is sensed and an updated prior injection history based on the desired injected fuel mass and the prior injection history is determined.

Figure 2:
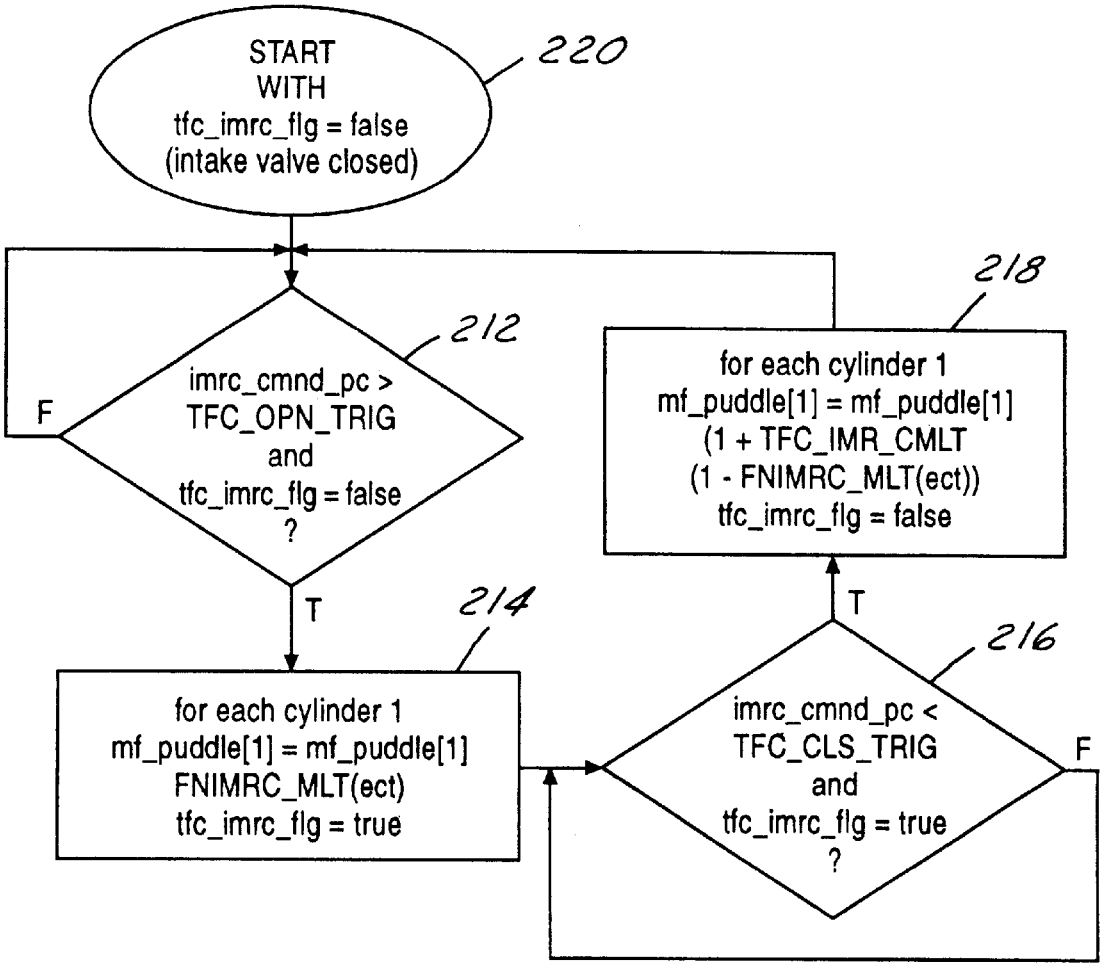
FIG. 2 is a flow diagram illustrating the sequence of steps associated with controlling fuel delivery during intake control device transitions in accordance with one embodiment of the present invention.

Referring to FIG. 2, a flow diagram illustrating the sequence of steps associated with controlling fuel delivery during intake control device transitions in accordance with one embodiment of the present invention is illustrated. In a software background loop the prior injection history is modified using the steps illustrated in FIG. 2. The sequence begins with step 210 when the engine is started and IMRC valve 54 is closed. The sequence then proceeds immediately to step 212.

The percent that IMRC valve 54 is open is determined in step 212 as a fraction from zero to one based on the time since the IMRC command to open IMRC valve 45 was generated by ECU 12. The percent that IMRC valve 54 is open is determined by referring to a model of the valve response, such as a lookup table. The percent that IMRC valve 54 is open is then compared to a first predetermined calibratable value, $TFC_{13}$ $OPN_{13}$ TRIG. When the percent that IMRC valve 54 is open exceeds the first predetermined calibratable value $TFC_{13}$ $OPN_{13}$ TRIG the sequence proceeds to step 214.

Referring back to step 212, if the IMRC valve is open in excess of first predetermined calibratable value TFC_ $OPN_{13}$ TRIG the sequence proceeds to step 214. The value for transient fuel puddle mass stored in ECU 12 is multiplied in step 214 by a second predetermined calibratable multiplier value $FNIMRC_{13}$ MTL. This value varies with engine coolant temperature. The resulting modified transient fuel puddle mass causes ECU 12 to adjust the amount of fuel to be injected by injector 44.

The predetermined calibratable multiplier value $FNIMRC_{13}$ MTL can initially be determined by known methods of engine mapping and calibration.

Referring back to step 214, after the transient fuel puddle mass value is modified, then the sequence proceeds to step 216. At this point, IMRC valve 54 is open. The percent that IMRC valve 54 is closed is determined in step 216 as a fraction from one to zero based on the time since the IMRC command to close IMRC valve 45 was generated by ECU 12. The percent that IMRC valve 54 is closed is determined by referring to a model of the valve response. This may be stored in ECU memory as a look up table. The percent that IMRC valve 54 is closed is then compared to a third predetermined calibratable value, $TFC_{13}$ $CLS_{13}$ TRIG. When the percent that IMRC valve 54 is closed is less then the third predetermined calibratable value $TFC_{13}$ $CLS_{13}$ TRIG the sequence proceeds to step 218.

In step 218, the value for transient fuel puddle mass stored in ECU 12 is multiplied by a fourth predetermined calibratable value in step 218 using the following equation:

$$mf_{puddle}=mf_{puddle}\cdot(1+TFC_{13}\ IMR_{13}CMLT\cdot(1-FNIMRC_{13}\ MLT)) \quad (2)$$

Where $mf_{puddle}$ represents the transient fuel puddle mass of each individual cylinder, $TFC_{13}$ $IMR_{13}$ CMLT represents a predetermined calibratable constant used to determine the amount to be removed on closing, and $FNIMRC_{13}$ MLT represents a predetermined calibratable multiplier value, which varies with engine coolant temperature. The resulting modified transient fuel puddle mass causes ECU 12 to adjust the amount of fuel to be injected by injector 44. The sequence then proceeds to step 212 and the background loop continues.

The method and system of the present invention provide improved accuracy of the engine fuel delivery. Advantages of this include: matched air charge in the cylinder during intake control device transitions, individual cylinder compensation using individual cylinder puddle estimates that account for all fuel injected into each cylinder, proper transient compensation for updates to injector pulsewidths after they have been scheduled, and proper accounting for dynamic (open-valve) injections. Thus, the present invention improves emissions and drivability by improving transient air-fuel control during engine fueling transients caused by intake control device transitions.

From the foregoing, it can be seen that there has been brought to the art a new and improved system for controlling air-fuel ratio during intake control device transitions. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. A method for determining fuel mass to be delivered to an individual cylinder of an internal combustion engine, comprising the steps of:

determining an initial base desired fuel mass as a function of a plurality of engine parameters;

determining an initial transient fuel mass as a function of a prior injection history;

modifying said prior injection history as a function of a state of a two-stage manifold;

comparing a percentage open of said two-stage manifold to a first predetermined calibratable value;

determining a desired injected fuel mass as a function of said initial base desired fuel mass and said initial transient fuel mass; and delivering the desired injected fuel mass.

2. The mod as recited in claim 1 where said step of modify said prior injection history as a function of a state of said two-stage manifold further comprises the step of multiplying a transient fuel puddle mass value by a second predetermined calibratable value.

3. The method as recited in claim 1 wherein said step of modifying said prior injection history as a function of a state of said two-stage manifold further comprises the step of comparing a percentage closed of said two-stage manifold to a third predetermined calibratable value.

4. The method as recited in claim 1 wherein said step of modifying said prior injection history as a function of a state of said two-stage manifold further comprises the step of multiplying a transient fuel puddle mass value by a fourth predetermined calibratable value.

5. A fuel control system having a plurality of cylinders and a two-stage intake manifold having an on state and an off state, each of said individual cylinders having an intake port for regulating entry of fuel into the cylinder and having a prior injection history indicating a mass of fuel previously delivered to the individual cylinder, said system comprising:

a plurality of sensors for sensing a plurality of engine parameters; and a ECU having control logic operative to determine an initial base desired fuel mass based on said plurality of engine parameters; determine an initial transient fuel mass based on said prior injection history, said injection history modified based on a state of said two-stage manifold; compare a percentage open of said two-stage manifold to a first predetermined calibratable value; determine a desired injected fuel mass to be delivered to said individual cylinder based on said initial base desired fuel mass and said initial transient fuel mass; and sense delivery of said desired injected fuel mass to said individual cylinder; and determine an updated prior injection history based on said desired injected fuel mass and said prior injection history.

6. The system as recited in claim 5 wherein the control logic is further operative to multiply a transient fuel puddle mass value by a second predetermined calibratable value.

7. The system as recited in claim 5 wherein the control logic is further operative to compare a percentage closed of said two-stage manifold to a third predetermined calibratable value.

8. The system as recited in claim 5 wherein the control logic is further operative to multiply a transient fuel puddle mass value by a forth predetermined calibratable value.

* * * * *